US009979101B2

(12) United States Patent
Chong et al.

(10) Patent No.: US 9,979,101 B2
(45) Date of Patent: May 22, 2018

(54) CORROSION PROTECTED COMMUNICATION CONNECTIONS AND RELATED METHODS

(71) Applicant: Radio Frequency Systems Inc., Meriden, CT (US)

(72) Inventors: Yin-Shing Chong, Middletown, CT (US); Timothy Bernhardt, Cheshire, CT (US)

(73) Assignee: Nokia Shanghai Bell, Shanghai (CN)

( * ) Notice: Subject to any disclaimer, the term of this patent is extended or adjusted under 35 U.S.C. 154(b) by 0 days. days.

(21) Appl. No.: 15/497,472

(22) Filed: Apr. 26, 2017

(65) Prior Publication Data

US 2017/0229806 A1 Aug. 10, 2017

Related U.S. Application Data

(63) Continuation-in-part of application No. 14/656,233, filed on Mar. 12, 2015.

(51) Int. Cl.

| | |
|---|---|
| ***H01R 4/66*** | (2006.01) |
| ***H01R 13/622*** | (2006.01) |
| ***H01R 13/52*** | (2006.01) |
| ***H01R 13/03*** | (2006.01) |
| ***H01R 24/40*** | (2011.01) |
| ***H01R 13/629*** | (2006.01) |
| ***H01R 9/05*** | (2006.01) |
| *H01R 101/00* | (2006.01) |

(52) U.S. Cl.

CPC ..... *H01R 4/66* (2013.01); *H01R 9/0512* (2013.01); *H01R 9/0521* (2013.01); *H01R 13/03* (2013.01); *H01R 13/5219* (2013.01); *H01R 13/622* (2013.01); *H01R 13/629* (2013.01); *H01R 24/40* (2013.01); *H01R 2101/00* (2013.01)

(58) Field of Classification Search

CPC ..... H01R 2103/00; H01R 13/5219; H01R 24/40; H01R 13/622; H01R 13/5205; H01R 2201/18; H01R 24/38; H01R 24/54; H01R 43/00; H01R 9/05; H01R 9/0521; H01R 4/66; H01R 9/0512; Y10S 439/939

USPC ..... 439/578, 583, 271

See application file for complete search history.

(56) References Cited

U.S. PATENT DOCUMENTS

| | | | | |
|---|---|---|---|---|
| 4,165,622 A | | 8/1979 | Brown | |
| 5,490,680 A | | 2/1996 | Patel | |
| 5,516,303 A | * | 5/1996 | Yohn | H01R 13/6315 439/248 |
| 6,361,049 B1 | | 3/2002 | Joco | |

(Continued)

*Primary Examiner* — James Harvey
*Assistant Examiner* — Matthew T Dzierzynski
(74) *Attorney, Agent, or Firm* — The Capitol Patent & Trademark Law Firm, PLLC

(57) ABSTRACT

Corrosion within a flangeless connector, or at an associated connection of a device or medium (e.g., cable), used in a wireless base station may be reduced by incorporating a seating member, e.g., an O-ring, between the connector and a connector port. Conductive plating selectively applied within the connector port may provide a low-resistance ground connection between the port and the connector, while a non-conductive coating selectively applied to a surface against which the seating member is seated may form a weather-tight seal. The connection between the connector and the connector port is thereby protected from moisture, while exposed surfaces of the connector port re protected by the non-conductive coating.

18 Claims, 5 Drawing Sheets

VIEW A

(56) References Cited

U.S. PATENT DOCUMENTS

| | | | | |
|---|---|---|---|---|
| 6,386,545 | B1 | 5/2002 | Evans | |
| 7,144,271 | B1 | 12/2006 | Burris | |
| 7,717,725 | B2 | 5/2010 | Montena | |
| 7,972,176 | B2 * | 7/2011 | Burris | H01R 9/0521 439/584 |
| 8,215,847 | B2 | 7/2012 | Aiudi | |
| 8,337,228 | B1 | 12/2012 | Montena | |
| 9,017,102 | B2 | 4/2015 | Natoli | |
| 9,453,600 | B2 | 9/2016 | Bailey | |
| 2002/0022403 | A1 | 2/2002 | Cheng | |
| 2004/0082218 | A1 | 4/2004 | Stirling | |
| 2011/0182551 | A1 | 7/2011 | Aiudi et al. | |
| 2014/0045357 | A1 | 2/2014 | Nugent | |
| 2014/0106612 | A1 | 4/2014 | Burris | |
| 2014/0322968 | A1 * | 10/2014 | Burris | H01R 9/05 439/578 |
| 2015/0061794 | A1 | 3/2015 | Tong | |
| 2015/0064957 | A1 | 3/2015 | Zhang | |

* cited by examiner

VIEW A

CORROSION PROTECTED COMMUNICATION CONNECTIONS AND RELATED METHODS

RELATED APPLICATION

This application is a continuation-in-part of U.S. application Ser. No. 14/656,233, filed Mar. 12, 2015 (the "'233 Application"), which is related to U.S. Patent Application Publication No. 2011/0182551 A1 (the "'551 Application"), where this application incorporates by reference herein the disclosures of the '233 Application and the '551 Application, including text and figures, as if such disclosure were set forth in its entirety herein.

INTRODUCTION

Existing wireless base stations utilize a number of different components, such as filters, amplifiers, transmitters and antennas all of which are typically connected using a variety of media, such as coaxial cable, fiber optic cable and conductive cabling (e.g., copper cables). At the junction of a cable and device there is typically a communications connector ("connector" for short) that joins or otherwise connects the cable to the device, for example.

The '551 Application discloses some examples of a flangeless connector.

One longstanding issue is galvanic corrosion of the connector, or at a connection of a device or medium composed of dissimilar materials (e.g., metals), caused by environmental factors (e.g., water seepage, salt, pollution, etc.,) alone and/or when combined with heating of the connector, connection, device or medium during operation.

It is desirable to provide flangeless connectors and associated devices or media that are designed to prevent or reduce corrosion along with related methods that prevent or reduce corrosion.

SUMMARY

Exemplary embodiments of flangeless, communications connectors and related methods for connecting such connectors to communications devices and media are described herein.

According to one embodiment, an inventive flangeless, communications connector may comprise a connector body configured with a recessed portion formed around an outer surface of the body to retainably receive a seating member, such as a deformable O-ring. The connector may be a mini-DIN connector (e.g., 4.1/9.5 min-DIN connector, 4.3/10 mini-DIN connector, 7/16 mini-DIN connector), or an N-type connector, for example. In addition, the connector may be further configured with one or more grip surface portions for rotatably adjusting the connector into a communications device, such as a filter, amplifier or transmitter, for example. These surfaces are named "grip" surface portions because they allow for a tool to grip a portion of a surface, or allow a person's hand to so grip such a portion to tighten, or loosen, (i.e., adjust) a connector. The grip surface portions may comprise flattened surface portions, raised surface portions, indents, or recessed holes, for example.

The incorporation of a recessed portion into a connector to retain and receive a seating member may aid in the reduction, and prevention, of corrosion by preventing water or other environmental elements from seeping into, or otherwise forming on, the connection formed by the connector and communications device. Further, the incorporation of grip surface portions may further aid in the reduction, and prevention, of corrosion by ensuring that an inventive connector is adequately fastened to a device or communications medium (e.g., cable) in order to prevent water or other environmental elements from seeping into, or otherwise forming on, the surfaces of the connector or device/medium involved in the connection.

In one embodiment the seating member may be an integral part of an inventive connector or device (e.g., pre-assembled as a part of an inventive connector). In another embodiment the seating member is a separate element. In the latter case, a seating member may be added to the connector or assembled with the connector or connection.

A connector body may be further configured with two oppositely positioned connection interfaces, where at least one of the oppositely positioned interfaces comprises threads for threadably connecting the connector to a device or communications medium (e.g., a communications medium selected from the group consisting of at least coaxial cable, optical fiber, and copper cable).

Inventive connectors provided by the present invention may be installed or otherwise connected to a system, device, medium or element as a separate component or, alternatively may be made an integral part of a system, device, medium or element prior to being installed or used. For example, in one embodiment a device, such as a filter, amplifier or transmitter to name just a few types of devices, may comprise an inventive flangeless, communications connector (e.g., mini-DIN connector or N-type connector). Similar to the inventive connectors described above (and herein) such an inventive, flangeless communications connector may comprise a connector body configured with a recessed portion formed around an outer surface of the body to retainably receive a seating member (e.g., a deformable O-ring), and further configured with one or more grip surface portions to rotatably adjust the connector. In one embodiment the connector is a 4.1/9.5 mini-DIN connector or 4.3/10 mini-DIN connector. In another embodiment the connector is a 7/16 mini-DIN connector. In yet a fourth embodiment the connector is an N-type connector.

In various embodiments, the seating member may be an integral part of an inventive connector, device or medium (e.g., pre-assembled as a part of an inventive connector, device or medium). In another embodiment the seating member is a separate element. In the latter case, a seating member may be added to the connector, device or medium, or assembled with the connector, device, medium or connection.

Yet further, a connector used as a part of a device may be further configured with two oppositely positioned connection interfaces, where at least one of the two oppositely positioned interfaces comprises threads for connecting the connector to another device, or medium, for example.

In addition to inventive connectors, the present invention also provides additional, inventive devices (e.g., filters, amplifiers or transmitters, etc.,) that may be used with inventive flangeless, communication connectors (e.g., mini-DIN connectors, N-type connector). In one embodiment, an inventive communications device may comprise a port or receptacle that may be configured to receive a flangeless connector, where inner surfaces of the port comprise conductive plating and outer surfaces of the port comprise an aluminum or polymer surface covered by a non-conductive coating (e.g., powder coating, paint). The conductive plating may comprise copper plating, for example.

Yet further, the communications device may further comprise an extended port for receiving a connector to aid in the ease of installation of the connector and to help reduce corrosion.

In addition to connectors and devices, the present invention provides related methods for connecting an inventive flangeless, communications connector (e.g., mini-DIN connector or an N-type connector) to a communications device. In one embodiment, an exemplary method includes positioning a connector, such as a 4.1/9.5 mini-DIN connector, a 4.3/10 mini-DIN connector, or a 7/16 mini-DIN connector, or an N-type connector, for example. The so-positioned connector may comprise a deformable seating member, such as an O-ring, in a recessed portion formed around an outer surface of a body of a threaded, flangeless connector configured to retainably receive the seating member; and, securing the connector to, or into, a communications device by applying a force (e.g., a rotatable force) to grip surface portions of the connector's body.

Additional embodiments and features will be apparent from the following detailed description and appended figures.

DETAILED DESCRIPTION, WITH EXAMPLES

Exemplary embodiments of flangeless, communications connectors, related devices and media, and related methods for connecting inventive connectors with devices or media are described herein and are shown by way of example in the figures. Throughout the following description and figures, like reference numbers/characters refer to like elements.

It should be understood that, although specific exemplary embodiments are discussed herein, there is no intent to limit the scope of the present invention to such embodiments. To the contrary, it should be understood that the exemplary embodiments discussed herein are for illustrative purposes, and that modified and alternative embodiments may be implemented without departing from the scope of the present invention.

It should also be understood that one or more exemplary embodiments may be described as a process or method. Although a process/method may be described as sequential, it should be understood that such a process/method may be performed in parallel, concurrently or simultaneously. In addition, the order of each step within a process/method may be re-arranged. A process/method may be terminated when completed, and may also include additional steps not included in a description of the process/method.

As used herein, the term "and/or" includes any and all combinations of one or more of the associated listed items. As used herein, the singular forms "a," "an" and "the" are intended to include the plural form, unless the context and/or common sense indicates otherwise. As used herein the word "member" is intended to include the plural form, unless the context and/or common sense indicate otherwise. It should be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The phrases "communications connector", "communication connector", "flangeless connector" and "connector" may be used interchangeably herein.

It should be understood that when a system, device, medium or element is referred to as being "connected" to or "joined" to (or other tenses of connected and joined) another system, device, medium or element or "installed" or "used" in (or another tense of installed or used) another system, device, medium or element such systems, devices, media or elements can be directly connected or joined to, or installed or used in, other or intervening systems, devices, media or elements to aid a connection, junction or installation. In the latter case, if the intervening systems, devices, media and elements are well known to those in the art they may not be described herein.

As used herein, the term "embodiment" refers to an example of the present invention.

Figure 1A:
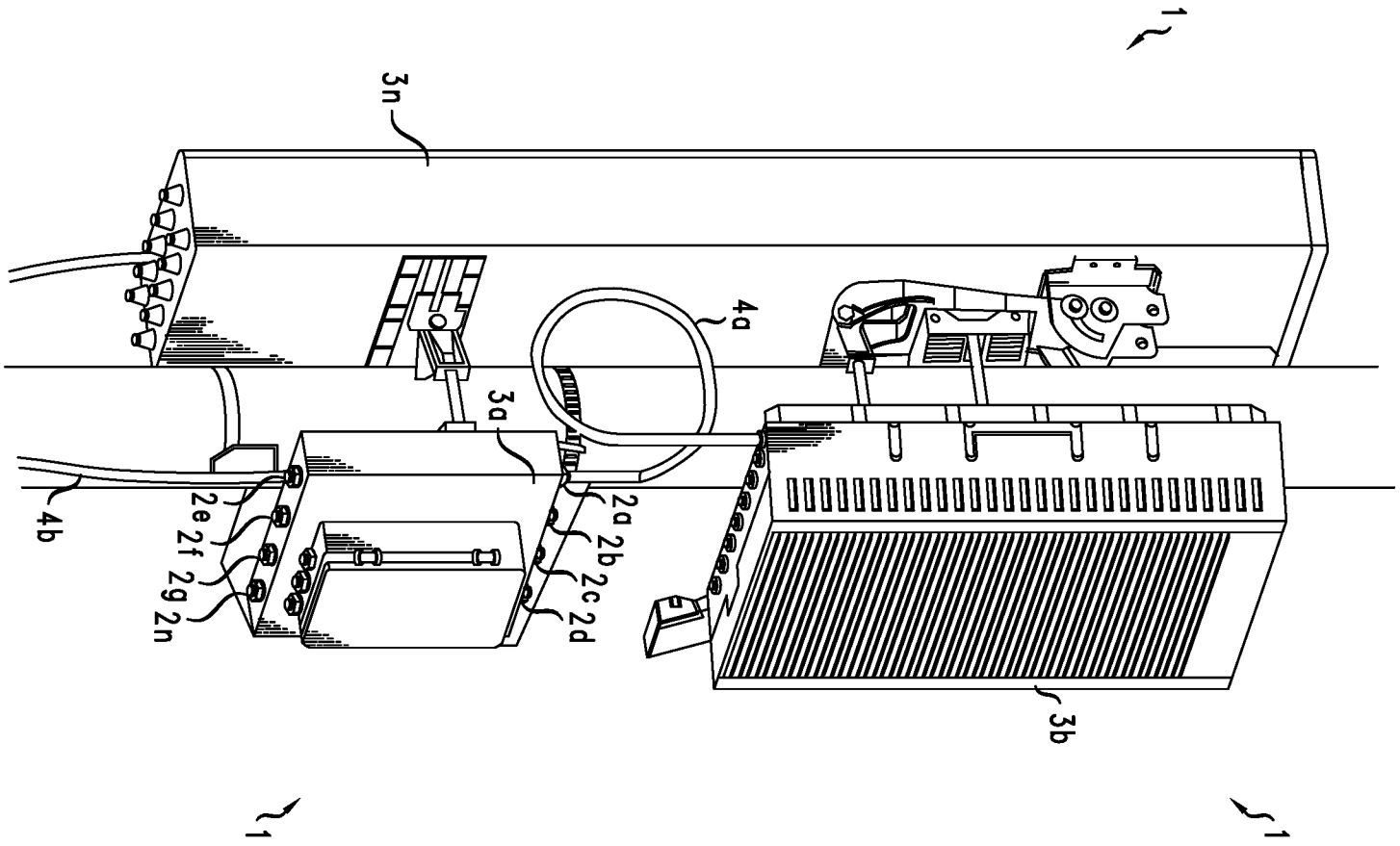
FIG. 1*a* depicts a system that includes exemplary connectors and devices according to an embodiment of the invention.

Turning to FIG. 1*a*, there is depicted a system 1 that includes exemplary, inventive flangeless communications connectors 2*a* through 2*n* (where "n" is the last connector) and devices 3*a* through 3*n* (where "n" is the last device) according to an embodiment of the invention. System 1 may comprise a transmission system used as a part of a wireless, communications base station, for example.

As shown, connectors 2*a* through 2*n* may be used to connect separate devices 3*a*, 3*b*, . . . 3*n* using communications media 4*a* and 4*b*. For example, device 3*a* may be a communications filter (e.g., radio frequency (RF) filter, where RF designates a commonly used descriptor for a filter, amplifier, transmitter or base station and not, strictly speaking, the frequency range of the filter, amplifier, transmitter or base station), device 3*b* may be a communications or network radio, and device 3*n* may be an antenna. Although only three types of devices are shown, it is should be understood that many types of communications devices commonly used as a part of an RF base station may be connected using exemplary connectors 2*a* through 2*n*. Another commonly connected device is an RF amplifier, to name just one example.

Inventive connectors 2*a*-2*n* may be operable to operate over a wide range of frequencies. Exemplary ranges are DC to 14 GHz (when a connector 2*a*-2*n* is a 4.1/9.5 mini-DIN connector), DC to 7.5 GHz (when a connector 2*a*-2*n* is a 7/16 mini-DIN connector) or 0 to 11 GHz (when a connector 2*a*-2*n* is an N-type connector) to name just a few of the many ranges within the scope of the present invention. Media 4*a* and 4*b* may comprise the same or a different type of communication medium, such as coaxial cable, fiber optic cable, or copper cable, for example.

Figure 1B:
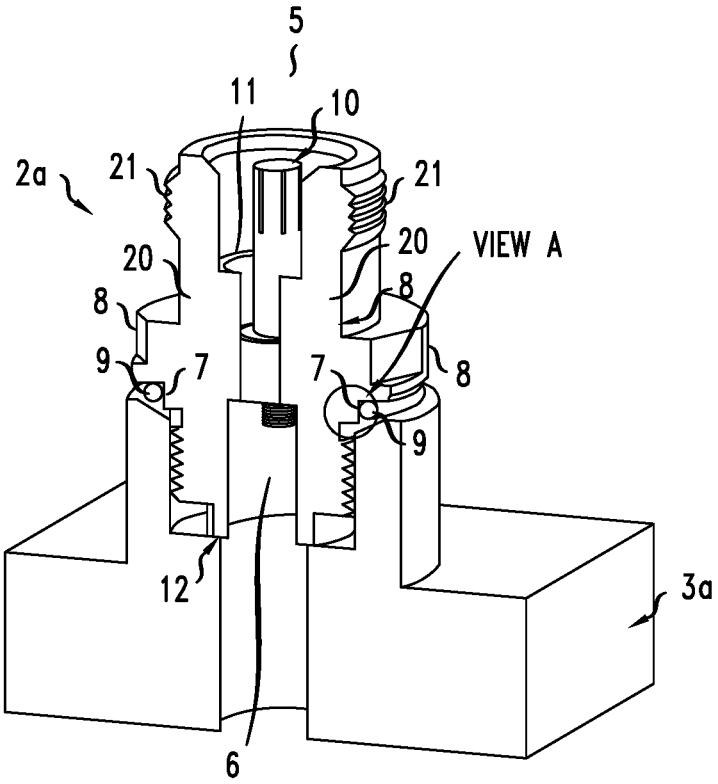
FIG. 1*b* depicts a cross-sectional view of an exemplary connector in accordance with one embodiment that may be used in the system depicted in FIG. 1*a*, for example.

Referring now to FIG. 1*b*, this figure depicts a cross-sectional view of an exemplary flangeless, communications connector, such as connector 2*a* in FIG. 1*a*, in accordance with one embodiment.

As shown the connector 2*a* may be connected to a device, such as a filter 3*a* in FIG. 1*a*. Connector 2*a* may include a body 20. Although body 20 is shown as cylindrical, this is merely exemplary. In additional embodiments body 20 may take the form of other shapes as well, such as polygonal, rectangular and elliptical. In an embodiment of the invention, body 20 may be configured with two oppositely positioned connection interfaces 5, 6. Still further, body 20 may be further configured to include a recessed portion 7 formed around an outer surface 8 of the body 20 for retainably receiving a seating member 9. In one embodiment the seating member 9 may be an integral part of connector 2*a* (e.g., pre-assembled as a part of a connector 2*a*). In another embodiment the seating member 9 is a separate element. In the latter case, a seating member 9 may be added to the connector 2*a* or assembled with the connector 2*a* or connection.

Interfaces 5, 6 may be configured to physically join different devices, media or elements to connector 2*a*. Interfaces 5, 6 may include a number of different types of structures or configurations, such as threads, fasteners, augur/tang, adhesive, and/or locking type connections. The interfaces 5, 6 may be similar or may be different. In the embodiment depicted in FIG. 1*b* at least one of the oppositely positioned connection interfaces, in this case interface 5, comprises threads 21. As shown in FIG. 1*a*, interface 5 may be configured to connect to a communications medium, such as medium 4*a* while interface 6 may be configured to connect to a device, such as device 3*a*. As before, the media may be selected from the group consisting of at least coaxial cable, optical fiber, and copper cable, for example.

The threads 21 used in interface 5 may comprise threads having a range of sizes or thread gauges, depending on the type of device or element to be connected. For example, if the connector 2*a* is a 7/16 mini-DIN connector the thread size is M29, if the connector 2*a* is a 4.1/9.5 mini-DIN connector the thread size will be M20, while if the connector 2*a* is an N-type connector the size will be 0.625 UNEF-2A for the external threads and 0.624UNEF-2B for the internal threads, for example.

As shown in FIG. 1*b*, the connector 2*a* may also include communications contacts 10, 11 housed in body 20 for communicatively connecting elements joined thereto. For example, body 20 may include inner contact 10 and outer contact 11 that may provide a conductive path or other communication mechanism between connector 2*a* and devices, media and elements connected thereto, such as device 3*a* and medium 4*a* in FIG. 1*a*. Inner contact 10 may be a 4.1, 4.3 or 7 mm connector, and outer contact 11 may be a 9.5, 10 or 16 mm connector, for example, such that connector 2*a* may comprise a 4.1/9.5, 4.3/10 or a 7/16 mini-DIN connector. Alternatively, connector 2*a* may be an N-type connector.

In the embodiment depicted in FIG. 1*b*, connector 2*a* is a female connector though male connectors are also within the scope of the present invention. Alternatively formed, sized and shaped contacts may be used as a part of an inventive connector, where the specific contacts may depend on the types of devices, media and elements to be connected by exemplary connectors. For example, connector 2*a* may include male contacts, contacts with different shapes, contacts at different relative positions, and/or contacts of different sizes.

Connector 2*a* may further include a grounding part 12. Grounding part 12 may be configured as a ringed surface that is part of an end portion of body 20, although other configurations, shapes and positions for grounding part 12 may be utilized depending on the desired application. Grounding part 12 may be electrically connected to body 20 to provide electrical grounding for connector 2*a* and/or to elements connected by, or to, connector 2*a*.

Figure 2:
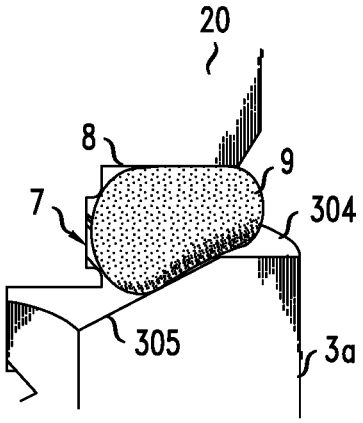
FIG. 2 depicts a simplified, enlarged cross-sectional view of a section of an exemplary connector according to an embodiment of the present invention.

FIG. 2 depicts a simplified, enlarged cross-sectional view of a section of the body 20 of connector 2*a*, and member 9 shown in FIG. 1*b* (see "View A" in FIG. 1*b*). As shown, body 20 may be configured to include a recessed portion 7 of an outer surface 8 that is configured to receive and retain (i.e., retainably receive) member 9 so that the member 9 may be retained within the recessed portion 7. In more detail, the use of a recessed portion 7 reduces the chances that member 9 will move from between body 20 and a surface of device 3*a* (i.e., slip out) as the connector 2*a* is screwed into, or otherwise connected to, the device 3*a* due to forces being applied during such a connection process or due to forces that exist after the process is completed. As positioned, member 9 may aid in the reduction and prevention of corrosion by preventing water or other environmental elements from seeping into or otherwise forming on, the connection formed by connector 2*a* and device 3*a*. In one embodiment the seating member 9 may be an integral part of an inventive connector 2*a* (e.g., pre-assembled as a part of the connector 2). In another embodiment the seating member 9 may be a separate element. In the latter case, a seating member 9 may be added to the connector 2*a* or assembled with the connector 2*a* or connection.

In one embodiment member 9 may comprise a deformable O-ring that in addition to preventing and reducing corrosion also facilitates physical connection between connector 2*a* and device 3*a*. Member 9 may be generally annular and fabricated of any sufficiently flexible material, including rubber, silicone, nitrile, etc. In addition to an O-ring, member 9 may comprise, for example, a suitable washer, gasket, and/or any other plastically or elastically deformable member, provided such member may be received and retained by recessed portion 7 or perform the same function as portion 7 and member 9.

Figure 3:
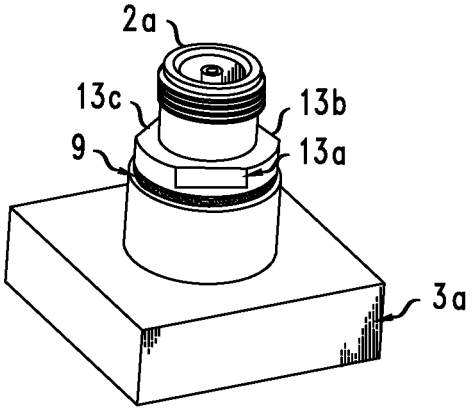
FIG. 3 depicts an exemplary connector shown connected to an exemplary device according to an embodiment of the present invention.

Referring now to FIG. 3, there is depicted another view of an exemplary flangeless connector, such as connector 2*a*, connected to an exemplary device, such as device 3*a*, according to another embodiment. As depicted the connector 2*a* may be configured with one or more grip surface portions 13*a*, 13*b* and 13*c*. The grip surface portions 13*a*, 13*b*, 13*c* may comprise flattened surface portions, raised surface portions, indents, or recessed holes, for example. Portions 13*a*, 13*b* and 13*c* may be gripped and then rotated using a tool (e.g., wrench) or manually by hand in order to rotatably adjust the connector 2*a* so that it is adequately fastened to device 3*a* or another medium or element.

Though three grip surface portions 13*a*, 13*b* and 13*c* are shown in FIG. 3 it should be understood that fewer, or more portions may be used. For example, the number of grip surface portions may be one, two, three or more, for example.

One exemplary method for connecting an inventive flangeless connector described herein, such as a threaded, flangeless mini-DIN connector or N-type connector (e.g., connector 2*a*) to a communications device, such as device 3*a*, or a medium or element is now described. Such a method may include positioning a flangeless connector at a desired connection or with a desired device or medium, the connector comprising a seating member, such as a deformable O-ring, positioned in a recessed portion formed around an outer surface of a body of the threaded, flangeless connector. As discussed above, the recessed portion may be configured to retainably receive the O-ring. In one embodiment the seating member may be an integral part of the connector (e.g., pre-assembled as a part of the connector). In another embodiment the seating member may be a separate element. In the latter case, the seating member may be added to the connector or assembled with the connector or connection. For example, the member may be initially positioned on a surface of a port or opening that is part of the device until the connector with recessed portion is placed on the port.

After the member is positioned the flangeless connector may be secured to, or into, the device a by applying a force (e.g., a rotatable force) to the one or more grip surface portions of the body using a tool, or manually by hand. The grip surface portions may aid in the reduction and prevention of corrosion by ensuring that an inventive connector is adequately fastened to a device or medium, for example, in order to prevent water or other environmental elements from seeping into or otherwise forming on, the surfaces of the connector and/or device involved in the connection.

It should be understood that inventive connectors provided by the present invention may be installed or otherwise connected to a system, device, medium or element as a separate component or, alternatively, may be made an integral part of a system, device, medium or element. For example, in one embodiment a device, such as a filter, amplifier or transmitter to name just a few types of devices, may comprise an integral, inventive connector operable to operate over a wide range of frequencies. Exemplary ranges are DC to 14 GHz (4.1/9.5 mini-DIN connector), DC to 7.5 GHz (7/16 mini-DIN connector), and 0 to 11 GHz (N-type connector) to name just a few of the many ranges within the scope of the present invention, for example.

A flangeless connector that is an integral part of a communications device (e.g., filter, amplifier, or transmitter) may include a connector body configured with two oppositely positioned connection interfaces, where: (i) at least one of the interfaces may include threads; (ii) at least one of the interfaces may be connected to the device; and (iii) another interface may be configured to connect to a communications medium (e.g., coaxial cable, optical fiber, and copper cable), for example. The body may be configured with a recessed portion formed around an outer surface of the body to retainably receive a seating member (e.g., deformable O-ring), and further be configured with one or more grip surface portions (e.g., flattened surface portions, raised surface portions, indents, or recessed holes, for example) for adjusting the connector (e.g., rotatably adjustments) so that it is adequately fastened to the device or medium. As before, in one embodiment the seating member may be an integral part of the connector (e.g., pre-assembled as a part of the device). In another embodiment the seating member is a separate element. In the latter case, a seating member may be added to the connector or assembled with the connector, device or connection.

Exemplary inventive connectors that may be made a part of an inventive device are a 4.1/9.5 mini-DIN connector, a 4.3/10 mini-DIN connector, a 7/16 mini-DIN connector or an N-type connector.

Figure 4:
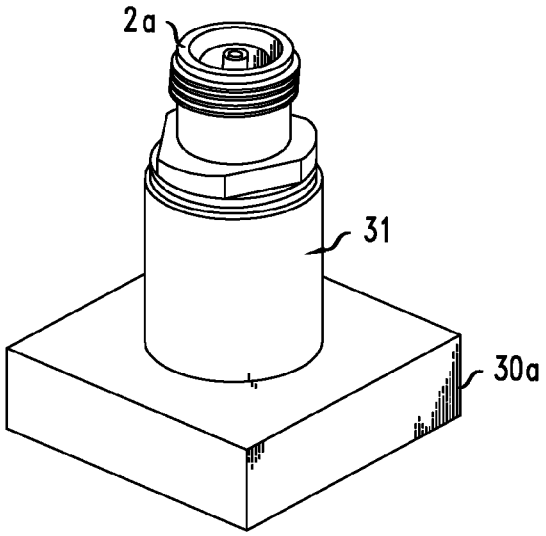
FIG. 4 depicts an exemplary connector shown connected to another exemplary device according to an embodiment of the present invention.

Referring now to FIG. 4 there is depicted an exemplary flangeless connector that is connected to another exemplary device according to yet another embodiment. In FIG. 4 an exemplary connector, such as connector 2*a*, is connected to a communications device 30*a* (e.g., filter, amplifier or transmitter, etc.,) that includes an extension, lengthened or extended port 31 (collectively "extended") for receiving the connector 2*a*. In such an embodiment the connector 2*a* may retain an original length. Said another way, only the length of the port 31 needs to be increased. The use of an extended port aids in the ease of installation of a connector and helps reduce corrosion because the further away the connector 2*a* and port 31 are from the main sections of device 30*a* the less likely contaminants (e.g., salt) will build up around the port 31 and connector 2*a*, for example.

Figure 5:
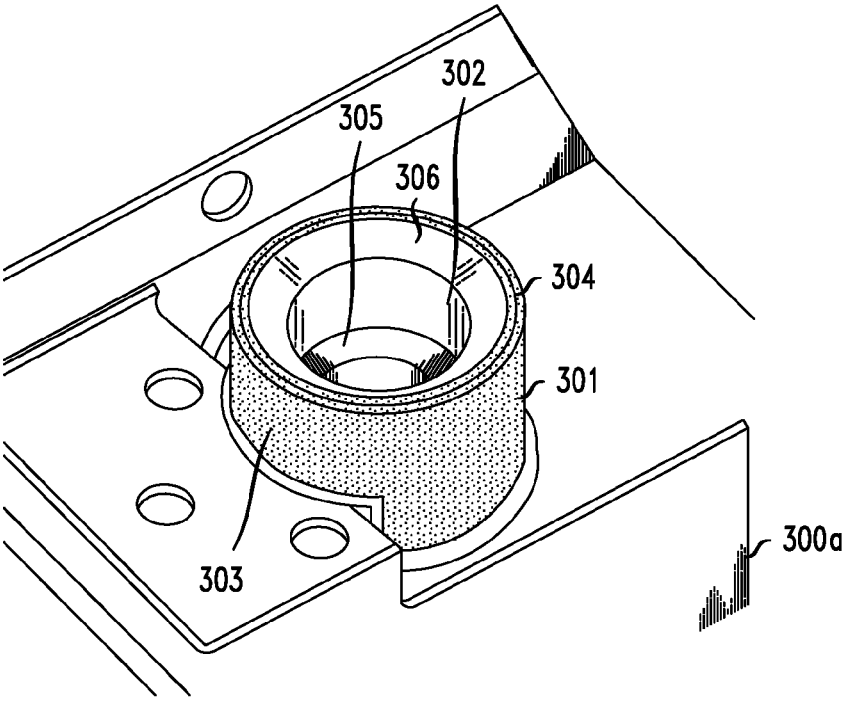
FIG. 5 depicts an exemplary port or receptacle of a device that may be configured to receive an exemplary connector according to an embodiment of the present invention.
Figure 6:
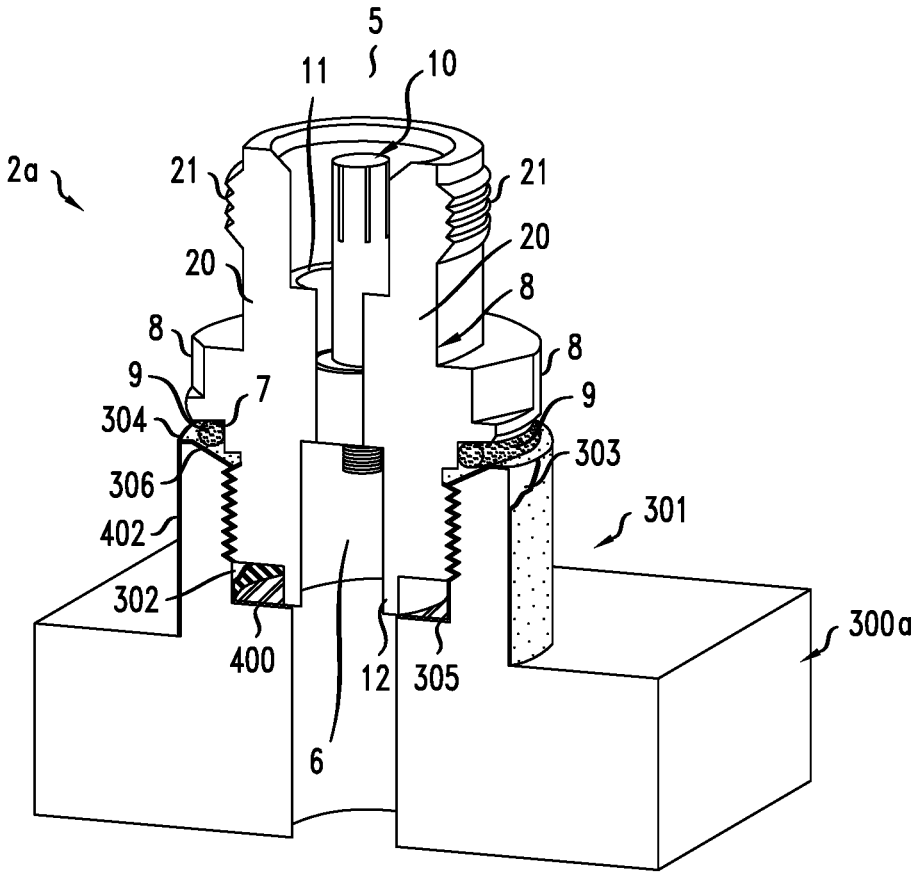
FIG. 6 depicts a cross-sectional view of the exemplary device depicted in FIG. 5, when deployed in combination with a connector body such as depicted in FIG. 2.

The present invention also provides additional, inventive devices (e.g., filter, amplifier or transmitter, etc.,) that may be used with inventive flangeless connectors. For example, FIG. 5 depicts a communications device 300*a* that includes an exemplary port or receptacle 301 (collectively "port"). The port 301 may be configured to receive an exemplary connector, such as connector 2*a* (not shown in FIG. 5). In one embodiment the inner surfaces 302 of the port 301 may comprise metallic, conductive plating while the outer surfaces 303 may not be plated. (The inner surfaces 302 are shown without threads for clarity.) For example, the inner surfaces 302 (except for an inner surface edge 304, described below) may comprise copper plating, for example, that covers the inner surfaces 302 up to, and including a grounding surface 305, which may form a ground with grounding part 12 of connector 2*a*, as shown in FIG. 6. In another embodiment, a beveled portion 306 of port 301 may also be excluded from the plating. The outer surfaces 303 may comprise an aluminum or polymer surface covered by a non-conductive coating (e.g., powder coating, paint). In addition, the inner surface edge 304 which is in contact with a seating member (not shown in FIG. 5), and optionally the beveled portion 306, may be covered by a non-conductive coating (e.g., powder coating, paint) as well. In this manner all of the surfaces that are plated may be protected from environmental conditions by a seal formed by a recessed, seating member and the contact surfaces of the connector (e.g., surface 8) and port 301. In contrast, the other exposed surfaces are coated or otherwise covered (i.e. treated) with a non-conductive powder coating or paint.

FIG. 6 depicts, in a cross-sectional view, communications device 300*a* in combination with flangeless connector 2*a*. In this view, the body 20 of flangeless connector 2*a* is shown as inserted into port 301 of device 300*a* such that threaded connector end 6 of connector 2*a* is positioned within port 301 and contacts grounding surface 305 of port 301. The view of FIG. 6 illustrates inner surfaces 302 and grounding surface 305 of communications device 300*a* as including a metallic, conductive plating surface layer 400. Preferably, metallic, conductive plating surface layer 400 comprises, without implied limitation, a layer of copper, which is known to be a good conductor (as well as relatively durable) over a relatively large temperature range. Moreover, it is preferred that the material used for conductive plating surface layer 400 is compatible with the material forming connection interface 6 of connector 2*a*. In some embodiments, the conductive plating surface layer 400 and the connection interface 6 are formed from a same material, e.g., copper. Using the same material for these two elements is a factor in reducing the possibility of galvanic corrosion, which may otherwise occurs in the presence of contact between two different metals. Also shown in this cross-sectional view of FIG. 6 is grounding part 12 of body 20. In this embodiment, grounding part 12 is in physical contact with conductive plating surface layer 400, providing a desired electrical grounding for the combination of elements.

As mentioned above and shown in FIG. 5, the coverage of conductive plating surface layer 400 may terminate at inner surface edge 304 of port 301, or optionally at the beveled portion 306. Indeed, in accordance with the principles of the present invention, inner surface 304, and optionally beveled portion 306, is covered with a non-conductive coating layer 402, as shown in FIG. 6. Outer surface 303 of device 300*a* is also shown as covered by non-conductive coating layer 402. In the cross-sectional view of FIG. 6, and in FIG. 2, seating member 9 is shown as contacting inner surface edge 304 and, therefore, forming part of a non-conductive, yet physical, connection between connector 2*a* and device 300*a*. Indeed, as mentioned above, the presence of seating member 9 as part of the flangeless connection reduces seepage and prevents corrosion by preventing water or other environmental elements from seeping into, or otherwise forming on, the connection formed between connector 2*a* and device 300*a*.

A variety of common materials may be used to fabricate the exemplary connectors described herein. For example, an inventive flangeless connector, such as connector 2*a*, may be fabricated from a tri-metal plated brass though other materials such as such as nickel, steel, aluminum, etc., or alloys thereof may be used. Alternately, an inventive connector may be fabricated from a dielectric plastic or composite if the connector is to be an insulating connector. Contacts, such as inner contact 10 and outer contact 11, may similarly be fabricated of a material having desired characteristics. For example, contacts 10 and 11 may be fabricated from a conductive material if an inventive connector is to carry or otherwise transmit or conduct an electric current. In light of the forgoing examples, it should be understood that many materials may be used in, and to form, exemplary inventive connectors.

Accordingly, corrosion within a flangeless connector, or at an associated connection of a device or medium (e.g., cable), used in a wireless base station may be reduced by incorporating a recessed portion in an outer surface of a body of the flangeless connector. The recessed portion helps retain a seating member, such as a deformable O-ring, to prevent water and other environmental material from seeping into the connector or connection. Further, the inner surfaces of a port of a device that receives the flangeless connector may be covered with a conductive plating, while outer surfaces of the port may be covered with a non-conductive coating.

Although exemplary flangeless connectors have been described and illustrated, it should be understood that the specific features or components shown in such exemplary connectors may be reshaped, resized, repositioned, or otherwise modified in order to be compatible with alternate applications without departing from the scope of the present invention. Further, it is understood that certain components, such as a grounding part, may be omitted entirely from an exemplary embodiment depending on the usefulness of these components or features in a particular application.

In sum, while exemplary embodiments have been shown and described herein, it should be understood that variations of the disclosed embodiments may be made without departing from the scope of the claims that follow.

We claim:

1. A communications connector comprising:

a connector body having a first threaded configuration interface configured to receive a radio-frequency (RF) cable connector and a second threaded connection interface configured to be received by a threaded connector port, the second connection interface terminating as a grounding ring part forming a continuous closed-loop grounding surface configured to form an electrical connection at a bottom surface of said connector port when said second connection interface is inserted into said connector port.

2. The connector as in claim 1 wherein the connector comprises a mini-DIN connector or an N-type connector.

3. The connector as in claim 1 wherein the connector is further configured with one or more grip surface portions to adjust the connector.

4. The connector as in claim 3 wherein the one or more grip surface portions comprise flattened surface portions, raised surface portions, indents, or recessed holes.

5. The connector as in claim 1 further comprising a seating member retained by a recessed portion formed around an outer perimeter of said second connection interface.

6. The connector as in claim 5 wherein the seating member comprises a deformable O-ring.

7. A communications device comprising:

a threaded port configured to receive a threaded connector body, the port having an outer surface, a beveled portion and a grounding surface at a bottom surface, wherein said bottom surface comprises a conductive plating and said beveled portion comprises a non-conductive coating.

8. The device as in claim 7 wherein the conductive plating comprises copper plating.

9. The device as in claim 7, further comprising an outer surface and an inner surface edge between said beveled portion and said outer surface, wherein said outer surface and said inner surface edge also comprise said non-conductive coating.

10. The device as in claim 9, further comprising a threaded portion between said beveled portion and said bottom surface, wherein said threaded portion also comprises said conductive plating.

11. The device as in claim 7, further comprising a connector body located within said threaded port such that a ground ring part of said connector body seats against said plated bottom surface.

12. The device as in claim 11, wherein said grounding ring part is plated with a same material as said plated bottom surface.

13. The device as in claim 7, further comprising a connector body locate within said threaded port and a seating member located between said threaded port and said connector body such that when compressed said seating member forms a seal against said beveled portion.

14. A method for connecting a communications connector to a communications device comprising:

inserting within a connector port of a communications device a connector body having a threaded connection interface comprising a grounding ring part forming a continuous closed-loop grounding surface at the termination of the connector body;

forming an electrical connection between said connector body and said connector port by causing said grounding ring 288 to contact a plated bottom surface at a base of said connector port; and compressing a seating member between said connector body and a surface of said connector port that comprises a non-conductive coating, thereby forming a seal between said connector port and said connector body.

15. The method as in claim 14 wherein the conductive plating comprises copper plating.

16. The method as in claim 14, wherein said surface is a beveled surface, and said connector port comprises an outer surface and an inner surface edge between said beveled surface and said outer surface, wherein said outer surface and said inner surface edge also comprise said non-conductive coating.

17. The method as in claim 16, wherein said connector port further comprises a threaded portion between said beveled portion and said bottom surface, wherein said threaded portion also comprises said conductive plating.

18. The method as in claim 14, wherein said grounding ring at is plated with a same material as said plated bottom surface.

* * * * *